United States Patent [19]

Takahashi et al.

[11] 4,200,075

[45] Apr. 29, 1980

[54] FUEL INJECTION APPARATUS

[75] Inventors: Kenji Takahashi; Takasuke Kumagai; Kazuyoshi Takaichi, all of Higashi-Matsuyama, Japan

[73] Assignee: Diesel Kiki Company, Ltd., Tokyo, Japan

[21] Appl. No.: 887,888

[22] Filed: Mar. 20, 1978

[30] Foreign Application Priority Data

Mar. 22, 1977 [JP] Japan ..... 52/31408

[51] Int. Cl.[2] ..... F02D 1/04; F02M 39/00

[52] U.S. Cl. ..... 123/140 FG; 123/139 AS

[58] Field of Search ..... 123/140 FG, 140 A, 140 FP, 123/139 AF, 139 AS, 139 B, 139 AG

[56] References Cited

U.S. PATENT DOCUMENTS

| | | | |
|---|---|---|---|
| 2,986,291 | 5/1961 | Schick | 123/140 FG |
| 3,620,648 | 11/1971 | Hofer et al. | 123/140 FG |
| 3,667,438 | 6/1972 | Moulin et al. | 123/139 AS |
| 3,789,818 | 2/1974 | Asbery et al. | 123/139 AS |
| 3,910,724 | 10/1975 | Okamoto | 123/140 FG |

*Primary Examiner*—Charles J. Myhre
*Assistant Examiner*—Magdalen Moy
*Attorney, Agent, or Firm*—David G. Alexander

[57] ABSTRACT

A line type fuel injection pump comprises a plurality of fuel injection pumps provided in a number one greater than the number of cylinders in an internal combustion engine. The extra injection pump constitutes a component of a liquid abutment regulator means and has an outlet connected to a control inlet of a modulator valve which modulates the supply pressure to the fuel injection pumps as a function of engine speed. A hydraulic actuator varies the amount of fuel injected into the engine in accordance with the supply pressure and may act in combination with a centrifugal governor.

15 Claims, 7 Drawing Figures

FUEL INJECTION APPARATUS

BACKGROUND OF THE INVENTION

The present invention relates to a fuel injection apparatus for an internal combustion engine comprising an improved liquid abutment type regulator means.

A prior art example of this type of apparatus is disclosed in U.S. Pat. No. 3,667,438 and comprises a large number of complicated component parts which are expensive to manufacture and sensitive to malfunction. Further comparable prior art suffering from the same drawbacks are disclosed in Japanese patent application No. 50-149725, Japanese utility model application No. 50-77611 and Japanese utility model publication No. 49-32503.

A regulator means of this type acts to modulate the pressure of fuel supplied to fuel injectors in accordance with engine speed. An actuator controls the fuel injection volume of the injectors in accordance with the fuel supply pressure. The apparatus may act either singly or in combination with a centrifugal or pneumatic governor to modify the fuel control function thereof.

SUMMARY OF THE INVENTION

A fuel injection apparatus for an internal combustion engine such as of the Diesel type comprises a fuel supply pump having an inlet and an outlet. A first fuel injection pump is connected to the outlet of the pump for injecting fuel into the engine, the first fuel injection pump having a fuel injection volume control member. A liquid abutment regulator means comprising a second fuel injection pump connected to the outlet of the pump modulates the output pressure of the pump as a predetermined function of engine speed. A hydraulic actuator positions the control member of the first fuel injection pump in accordance with the output pressure. The regulator means may act in combination with a centrifugal or pneumatic governor.

It is an object of the present invention to provide a fuel injection apparatus for an internal combustion engine which operates with improved efficiency and is less subject to malfunction than comparable prior art apparatus.

It is another object of the present invention to provide a fuel injection apparatus comprising a liquid abutment type regulator means, a fuel injection pump of the regulator means being identical to fuel injection pumps for the engine except for modifications of small component parts thereof.

It is another object of the present invention to provide a liquid abutment regulator means for a line type fuel injection pump which is configured in such a manner as to comprise components identical or similar to the fuel injection pumps and thereby minimize manufacturing and maintenance costs, and spare parts inventory.

It is another object of the present invention to provide a generally improved fuel injection apparatus for an internal combustion engine.

Other objects, together with the foregoing, are attained in the embodiments described in the following description and illustrated in the accompanying drawing.

DESCRIPTION OF THE PREFERRED EMBODIMENTS

While the fuel injection apparatus of the invention is susceptible of numerous physical embodiments, depending upon the environment and requirements of use, substantial numbers of the herein shown and described embodiments have been made, tested and used, and all have performed in an eminently satisfactory manner.

Figure 1:
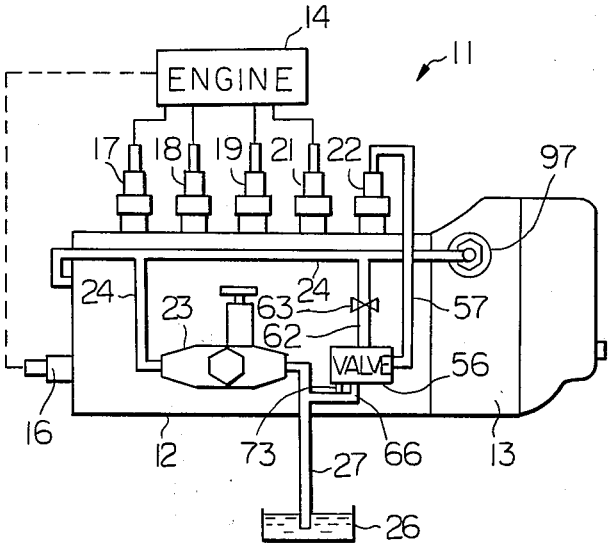
FIG. 1 is a simplified side elevation of a fuel injection apparatus embodying the present invention.

Referring now to FIG. 1 of the drawing, a fuel injection apparatus embodying the present invention is generally designated by the reference numeral 11 and comprises a fuel injection pump 12 and a governor 13 which are integrally attached together. The fuel injection pump 12 is arranged to inject fuel into an internal combustion engine 14 which drives a camshaft 16 of the pump 12. The fuel injection pump 12 comprises four fuel injection pumps 17, 18, 19 and 21 which are connected to respective cylinders (not shown) of the engine 14. The fuel injection pump 12 further comprises a fifth injection pump 22 which will be described below. The fuel injection pump 12 is of the line type since the injection pumps are arranged in a straight line. The number of injection pumps is equal to the number of cylinders in the engine 14 plus one.

Figure 3:
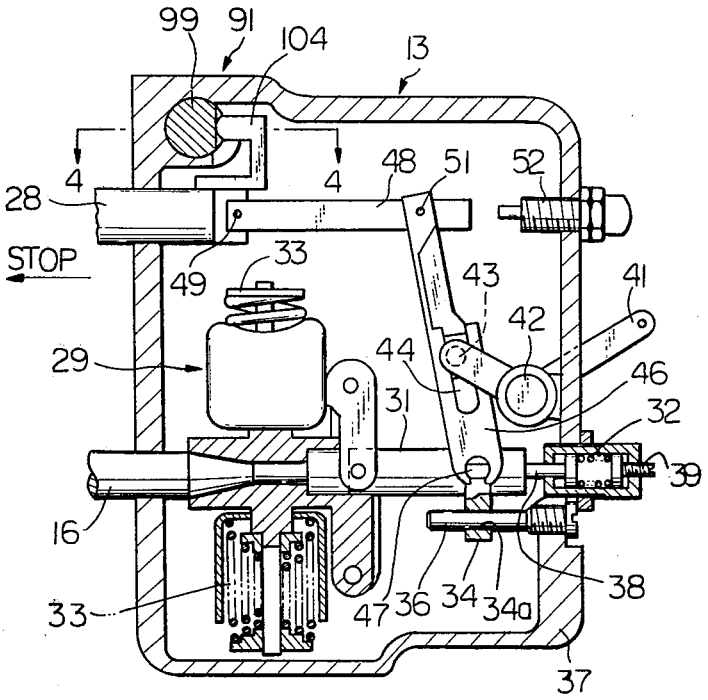
FIG. 3 is a side elevation, partly in section, of a governor of the apparatus.

A fuel supply pump 23 is arranged to supply fuel to the injection pumps 17, 18, 19, 21 and 22 through a conduit 24 connected to the outlet (not designated) of the pump 23. The inlet (not designated) of the pump 23 is connected to a fuel tank 26 through a conduit 27. The amount of fuel injected into the engine 14 by the injection pumps 17, 18, 19 and 21 is determined by the position of a control rack 28 of the governor 13 which is shown in FIG. 3. The rack 28 meshes with control sectors (not shown) of the injection pumps 17, 18, 19 and 21 in a manner known in the art.

The governor 13 comprises flyweights 29 which are rotatably driven by the camshaft 16. As the engine speed increases, the flyweights 29 are urged to expand due to centrifugal force and urge a shifter rod 31 rightwardly as viewed in FIG. 3. At an engine speed below N1 (see FIG. 6) the shifter rod 31 is moved by the flyweights 29 against the force of a compression spring 32 which serves as an idling spring.

Governor springs 33 are provided to the flyweights 29 in such a manner that the flyweights 29 begin to expand against the compressive force thereof at a speed N2, or after the spring 32 is compressed to a certain extent. In other words, the flyweights 29 move the shifter rod 31 rightwardly against the compressive force of the spring 32 at engine speeds from zero to N1. At the speed N1 the movement of the flyweights 29 and shifter rod 31 is such that the flyweights 29 engage and begin to apply a compressive force to the springs 33. However, it is not until the speed N2 that the flyweights 29 develop sufficient centrifugal force to actually compress the springs 33 and move the shifter rod 31 further rightwardly. The shifter rod 31 is provided with a downwardly extending lug 34 formed with a hole 34*a* through which slidably extends a guide shaft 36 fixed to a housing 37 of the governor 13. This arrangement allows the shifter rod 31 to move axially but prevents rotation thereof. Further illustrated are a plunger 38 fixed to the end of the shifter rod 31 and a plug 39, the spring 32 being compressed between the plunger 38 and plug 39. The plug 39 is threaded so as to allow adjustment of the preload of the spring 32.

A speed control lever 41 is pivotally mounted to the housing 37 about a shaft 42. A pin 43 provided to the left end of the lever 41 is slidably received in a slot 44 of a floating lever 46. The lower end of the floating lever 46 is pivotally connected to the shifter rod 31 by a pin 47.

The control rack 28 is axially slidable in the housing 37 and is pivotally connected at its inner (right) end to a link 48 by a pin 49. The other end of the link 48 is pivotally connected to the upper end of the floating lever 46 by a pin 51.

Figure 6:
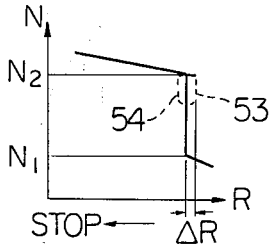
FIG. 6 is a graph illustrating various control functions.

The elements described thus far constitute a known centrifugal governor. In operation, the shifter rod 31 is moved rightwardly by the flyweights 29 as the engine speed increases. The shifter rod 31 is only actually moved below the speed N1 and above the speed N2 as illustrated in FIG. 6. The abscissa axis represents the displacement R of the control rack 28 and the ordinate axis represents the engine speed N. Leftward movement of the control rack 28 in FIG. 3 decreases the volume of fuel injection.

Rightward movement of the shifter rod 31 causes the floating lever 46 to pivot counterclockwise about the pin 43 which acts as a fulcrum. This causes the control rack 28 to moved leftwardly through the link 48 to decrease the fuel injection volume.

The governor 13 is known as a two-speed governor since it only controls the engine speed below N1 and above N2. The spring 32 acts to increase the fuel supply during low speed operation such as starting or idling, thereby preventing stalling of the engine 14. The speed N2 is the maximum speed at which the engine 14 is designed to be operated. Runaway under low load conditions would occur without the provision of the governor 13 which serves to sharply decrease the fuel supply above N2, thereby reducing the engine speed and preventing damage or destruction of the engine 14. It will be noted that the flyweights 29 and springs 32 and 33 have no effect on the amount of fuel injection or the engine speed between N1 and N2. Control of the engine speed between these limits is by means of the control lever 41.

Clockwise rotation of the control lever 41 causes the floating lever 46 to pivot clockwise about the pin 47, which in this case serves as a fulcrum. The control rack 28 is moved rightwardly thereby to increase the fuel injection volume and engine speed. In an essentially similar manner, the fuel injection volume is decreased by rotating the control lever 41 counterclockwise. An adjustable stop 52 fixed to the housing 37 limits the maximum fuel injection volume through abutment of the right end of the link 48 therewith.

It will be clear that there is no movement of the shifter rod 31 between the speeds N1 and N2. However, it is often desirable from the standpoints of reducing pollutant emission and maximizing fuel economy to vary the fuel injection volume between N1 and N2 in accordance with such operating conditions as ambient temperature and pressure which determine the density of engine induction air. Exhaust gas pressure and the like also affect the combustion in the engine 14. For example, as indicated by a phantom line curve portion 53 in FIG. 6, it may be desirable to increase the fuel injection volume at speeds just below N2 to compensate for increased superchanged induction air pressure or the throttling effect of the various injection pump components at high speed. This is accomplished by moving the control rack rightwardly by a distance $\Delta R$. Alternatively, it may be desirable to decrease the fuel injection volume as indicated by a curve portion 54 to compensate for increased fuel pump efficiency at high speed. The governor 13 as described thus far is incapable of such compensation.

Figure 5:
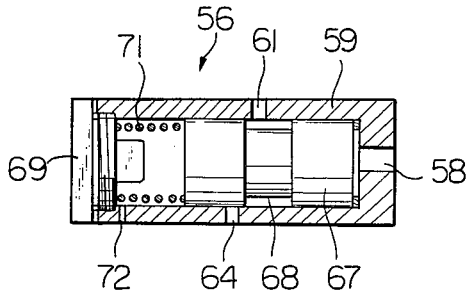
FIG. 5 is a sectional view of a modulator valve of the apparatus.

To overcome this limitation, the present apparatus 11 comprises a pilot or modulator valve 56 which has a control input 58 connected to the outlet of the injection pump 22 through a passageway or conduit 57. The modulator valve 56 is shown in detail in FIG. 5 and comprises a blind bored cylinder 59 with the control inlet 58 formed through the right end thereof. An inlet 61 leads from the bore of the cylinder 59 to the conduit 24 through a conduit 62. A flow restrictor 63 is provided to the conduit 62. The cylinder 59 is further formed with an outlet 64 which is connected to the conduit 27 through a conduit 66, the outlet 64 being axially spaced from the inlet 61.

A valve element or spool 67 is sealingly slidable in the bore of the cylinder 59 and is formed with an annular groove 68. A plug 69 is screwed into the left end of the cylinder 59. A compression spring 71 disposed between the left end of the valve spool 67 and the plug 69 urges the spool 67 against the right end of the bore of the cylinder 59. In this position, the inlet 61 is uncovered by the groove 68 but the outlet 64 is covered by the left portion of the spool 67. Further illustrated is a drain outlet 72 which allows any fuel which leaks leftwardly past the spool 67 from the inlet 61 to drain to the conduit 27 and fuel tank 26 through a conduit 73.

Figure 2:
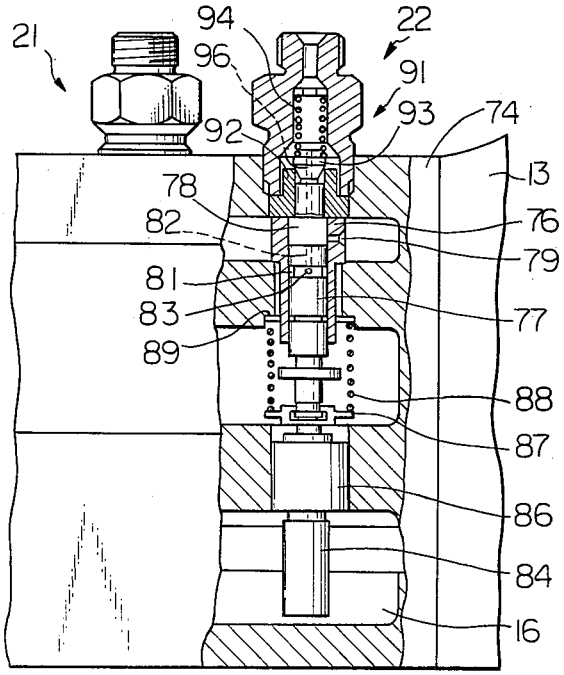
FIG. 2 is a sectional view of a fuel injection pump of the apparatus.

The fuel injection pump 12 is illustrated in detail in FIG. 2 as comprising a housing 74 which receives the injection pumps 17, 18, 19, 21 and 22 in addition to the camshaft 16. The injection pump 22 comprises a bored cylinder 76 in which is sealingly slidably received a plunger or piston 77. The cylinder 76 and piston 77 define a pressure chamber 78. Fuel from the conduit 24 is admitted into the pressure chamber 78 through an inlet 79 when the piston 77 is in the lower illustrated position. The piston 77 is formed with an annular groove 81 which communicates with the pressure chamber 78 through an axial passageway 82 and a radial passageway 83.

The camshaft 16 has a cam 84 of generally oval cross section fixed thereto. A tappet 86 is interposed between the lower end of the piston 77 and the cam 84. A spring seat 87 is fixed to the piston 77. A compression spring 88 provided between a shoulder 89 of the housing 74 and the spring seat 87 urges the piston 77 downwardly into constant engagement with the cam 84 through the tappet 86.

A check valve 91 disposed above the pressure chamber 78 comprises a valve seat 92 and a valve element 93 which is urged downwardly into engagement with the valve seat 92 by a compression spring 94. In accordance with the present invention, the valve element 93 is formed with an axial passageway 96 therethrough.

Figure 4:
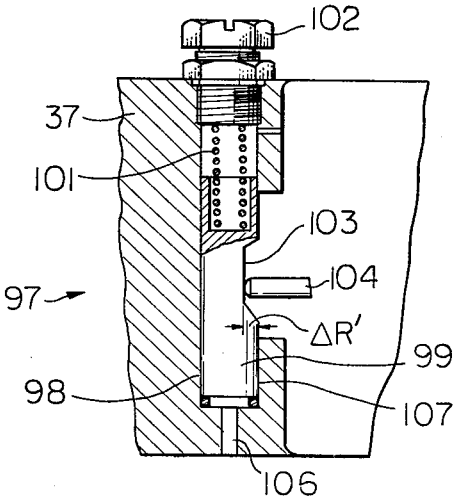
FIG. 4 is a sectional view of an actuator of the apparatus, taken on a line 4—4 of FIG. 3.

The present apparatus 11 further comprises a hydraulic actuator 97 which is provided to the housing 37 of the governor 13 and shown in detail in FIG. 4. The housing 37 is formed with a cylindrical bore 98 in which is sealingly slidable a piston 99. A compression spring 101 disposed between an adjustable plug 102 and the upper end of the piston 99 urges the piston 99 downwardly into engagement with the lower end of the bore 98. An intermediate portion of the piston 99 is cut at 103. A cam follower 104 fixed to the control rack 28 is engageable with the piston 99 as illustrated. The cutaway 103 and the portion of the piston 99 therebelow define a cam (not designated). The lower portion of the bore 98 communicates with the conduit 24 through an inlet 106.

Although not illustrated in detail, the injection pumps 17, 18, 19 and 21 are similar to the injection pump 22 except that pistons thereof (not shown) are formed with a spiral groove for variation of the fuel injection volume. The pistons are rotated by means of sectors fixed thereto which mesh with the control rack 28. It will be noted that the annular groove 81 of the injection pump 22 allows no adjustment of fuel injection volume, and that the injection pump 22 injects a fixed amount of fuel. The other difference is that check valve elements (not shown) in the injection pumps 17, 18, 19 and 21 are not formed with the axial passageway 96.

In operation, the fuel supply pump 23 feeds fuel from the tank 26 to the injection pumps 17, 18, 19 and 21 which inject the fuel into the respective cylinders of the engine 14. The governor 13 controls the fuel injection volume in the manner described hereinabove. The engine speed is controlled between N1 and N2 by means of the control lever 41.

The piston 77 of the injection pump 22 is reciprocated by the cam 84 between a lower position as illustrated and an upper position. In the lower position, fuel enters the pressure chamber 78 through the inlet 79 and also fills the axial passageway 82, radial passageway 83 and annular groove 81. The check valve element 93 is seated against the valve seat 92.

As the piston 77 is moved upwardly by the cam 84, the upper edge of the piston 77 moves over the inlet 79 so that the inlet 79 is blocked by the piston 77. Further upward movement of the piston 77 causes the increasing fuel pressure in the pressure chamber 78 to move the valve element 93 upwardly off the valve seat 92. Fuel is thereby displaced by the piston 77 through the check valve 91 and conduit 57 to the modulator valve 56.

Upon further upward movement of the piston 77 the annular groove 81 aligns with the inlet 79. This connects the pressure chamber 78 to the conduit 24 through the passageways 82 and 83, groove 81 and inlet 79. The pressure in the pressure chamber 78 drops to the pressure in the conduit 24 almost instantaneously. The force of the spring 94 overcomes the pressure in the pressure chamber 78 and seats the valve element 93 against the valve seat 92. The piston 77 is then moved downwardly by the spring 88 and the injection cycle is repeated.

The fuel from the injection pump 22 is injected into the modulator valve 56 through the control inlet 58 and urges the valve spool 67 leftwardly against the force of the spring 71. As the piston 77 is moved downwardly, fuel flows in the reverse direction from the bore of the cylinder 59 through the inlet 58 back into the pressure chamber 78 through the axial passageway 96 of the valve element 93. Whereas a fixed amount of fuel is injected into the modulator valve 56 by the injector 22, the amount of fuel which flows back during the downward movement of the piston 77 depends upon the length of time of the downward stroke of the piston 77, or upon the engine speed. The higher the engine speed, the less time for downward movement of the piston 77 and the smaller the amount of reverse fuel flow. It will be noted that the valve spool 67 is moved leftwardly during the upward movement of the piston 77 due to the increasing pressure and moves rightwardly during the downward movement of the piston 77 due to the reverse fuel flow and the decreasing fuel pressure acting on the spool 67.

At low engine speeds, the leftward displacement of the valve spool 67 is small, and the spool 67 may not be moved sufficiently that the groove 68 uncovers the outlet 64. In this case, the inlet and outlet 61 and 64 of the modulator valve 56 and the inlet and outlet of the pump 23 respectively are completely disconnected and the output pressure of the pump 23 is maximum. However, further leftward movement of the valve spool 67 causes the groove 68 to partially or completely uncover the outlet 64, depending upon the position of the spool 67. This communicates the inlet 61 with the outlet 64 through the groove 68 and thereby connects the inlet of the pump 23 to the outlet thereof through the modulator valve 56. The greater the degree of communication between the inlet and outlet of the pump 23, the lower the fuel pressure in the conduit 24 since fuel is bypassed from the outlet of the pump 23 to the inlet thereof.

Although the valve spool 67 moves back and forth in the cylinder 59 in the manner described, the average position thereof depends on the engine speed in accordance with the liquid abutment principle. The greater the engine speed, the less the reverse fuel flow through the axial passageway 96 of the valve element 93 and the more leftward the average position of the valve spool 67. This results in more bypass of fuel through the modulator valve 56 and lower fuel pressure in the conduit 24. The flow restriction 63 serves to smooth the fluid flow through the modulator valve 56, so that the pressure in the conduit 24 has a substantially non-pulsating value which depends upon the average position of the valve spool 67. In summary, the fuel pressure in the conduit 24 decreases as the engine speed increases in accordance with the liquid abutment principle due to the action of the injection pump 22 and modulator valve 56 in combination.

As viewed in FIG. 4, the fuel pressure in the conduit 24 acts on the piston 99 of the actuator 97 through the inlet 106. More specifically, the pressure in the conduit 24 urges the piston 99 upwardly against the force of the spring 101. The higher the engine speed and the lower the fuel pressure in the conduit 24, the lower the position of the piston 99 in the bore 98.

At engine speeds above a predetermined value, the fuel pressure is insufficient to overcome the preload of the spring 101 and the piston 99 assumes the lowermost position thereof as illustrated in FIG. 4. In this case, the cam follower 104 is aligned with the cutout 103 of the piston 99. However, as the engine speed decreases below the predetermined value, the piston 99 is moved upwardly against the force of the spring 101 so that the cam follower 104 is aligned with the portion of the piston 99 below the cutout 103, which is designated as 107. The depth of the cutout 103, or the distance from the bottom of the cutout 103 to the face of the portion 107, is designated as $\Delta R'$.

The piston 99 serves to limit the movement of the control rack 28 in the fuel decreasing direction. Thus, at engine speeds above said predetermined value, the minimum value of fuel injection is less than at engine speeds above said predetermined value by an amount corresponding to a displacement of the control rack 28 by the distance $\Delta R'$. The piston 99 serves as a limit stop for the cam follower 104 and thereby the control rack 28. Thus, at any given engine speed, the control rack 28 may be moved by the flyweights 29 and/or the control lever 41 in the fuel decreasing direction only to an extent depending on the axial position of the piston 99. This function may be adapted to reduce pollutant emission during deceleration of the engine 14 or compensate engine operation in any other desired manner.

In accordance with the present invention, a hydraulic actuator such as the actuator 97 may be adapted to limit the minimum fuel injection volume, maximum fuel injection volume, or to control the fuel injection volume in combination with the flyweights 29 and control lever 41 in a continuous manner through a linkage mechanism or the like, although not shown. The actuator may be connected with the governor either in series or parallel. The actuator may be mounted in any convenient location such as external of the governor 13.

Figure 7:
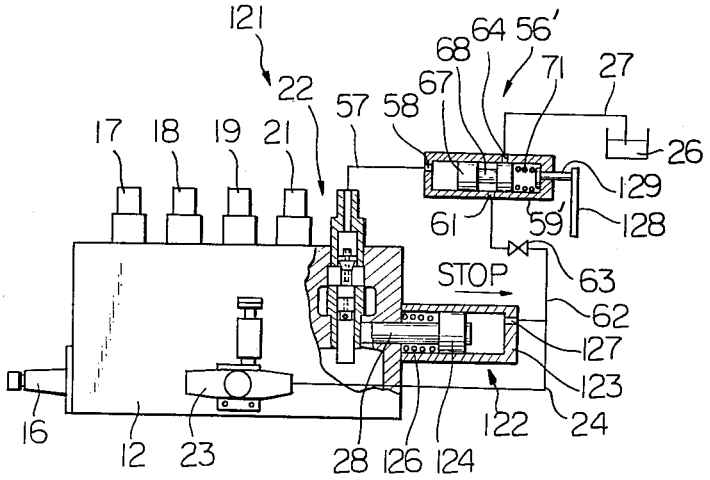
FIG. 7 is a schematic side elevation, partly in section, of a second embodiment of the present invention.

FIG. 7 illustrates another fuel injection apparatus of the present invention which is designated as 121. Only those elements which are necessary for an understanding of the embodiment are shown. Like elements are designated by the same reference numerals used for the apparatus 11 and corresponding but modified elements are designated by the same reference numerals primed.

In the apparatus 121, the governor 13 is omitted and a hydraulic jack or actuator 122 is used to position the control rack 28. The actuator 122 comprises a bored cylinder 123 in which a piston 124 is sealingly slidable. The control rack 28 is connected to the piston 124 for integral movement in such a manner that rightward movement of the piston 124 and control rack 28 decrease the fuel injection volume. A compression spring 126 urges the piston 124 rightwardly. An inlet 127 is formed through the right wall of the cylinder 123 in such a manner that the right face of the piston 124 is exposed to the pressure in the conduit 24 therethrough.

In operation, the pressure is reduced in the conduit 24 by the injection pump 22 and a slightly modified modulator valve 56' in the manner described above. At engine speeds below a predetermined value, the output pressure of the injection pump 22 is insufficient to overcome the preload of the spring 71 of the modulator valve 56', and maximum fuel pressure is applied to the actuator 122. This pressure overcomes the force of the spring 126 and moves the piston 124 and control rack 28 leftwardly to a maximum fuel injection position. As the engine speed exceeds the predetermined value, the piston 67 of the modulator valve 56' overcomes the preload of the spring 71 and moves rightwardly to unblock the outlet 64, thereby reducing the pressure in the conduit 24. As a result, the piston 124 and control rack 28 are moved rightwardly by the spring 126 to reduce the fuel injection volume. This action tends to maintain the engine speed at the predetermined value. In the modulator valve 56', the plug 69 is replaced with a control lever 128 fixed to the end of a threaded spring seat 129. Rotation of the lever 128 causes the spring seat 129 to be screwed in or out of a cylinder 59' and vary the preload of the spring 71. This has the effect of varying the predetermined speed at which the engine 14 is desired to operate. In other words, the control lever 128 sets the desired engine speed and the injection pump 22, modulator valve 56' and actuator 122 function to maintain the engine speed at the desired predetermined value. The engine speed is continuously variable by means of the control lever 128.

In summary, it will be seen that the present invention provides a fuel injection apparatus which features improved performance at lower manufacturing and maintenance cost. The fact that the injection pump 22 is identical to the injection pumps 17, 18, 19 and 21 except for the construction of the piston 77 and valve element 93 greatly simplifies the design of the apparatus since the only modification required to a known fuel injection pump is to provide one extra injection pump.

Various modifications such as reversing the positions of the inlet 61 and outlet 64 of the modulator valve 56 will become possible for those skilled in the art after receiving the teachings of the present disclosure without departing from the scope thereof. A typical modification which further reduces the number of spare parts for the apparatus is to replace the piston 77 of the injection pump 22 with a piston identical to those of the injection pumps 17, 18, 19 and 21. In this case, the control segment for the piston would be omitted or maintained out of mesh with the control rack and means provided to prevent rotation of the piston. The volume of fuel injection of the piston in this case may be present during manufacture through adjustment of the rotational position of the piston.

What is claimed is:

1. A fuel injection apparatus for an internal combustion engine comprising:

a fuel supply pump having an inlet and an outlet;

a first fuel injection pump connected to the outlet of the fuel supply pump for injecting fuel into the engine, the first fuel injection pump having a fuel injection volume control member;

a liquid abutment regulator means comprising a second fuel injection pump connected to the outlet of the fuel supply pump for modulating an output pressure of the fuel supply pump in accordance with engine speed; and actuator means for positioning the control member in accordance with the output pressure.

2. An apparatus as in claim 1, in which the second fuel injection pump is constructed to inject a fixed volume of fuel.

3. An apparatus as in claim 2, in which the second fuel injection pump comprises an outlet check valve formed with an axial passageway therethrough.

4. An apparatus as in claim 3, in which the second fuel injection pump comprises a bored cylinder, a piston sealingly slidable in the cylinder bore, means for reciprocating the piston, valve means for admitting fuel into the cylinder bore for injection by the piston and an outlet passageway leading from the cylinder bore, the check valve being provided to the outlet passageway, the check valve being normally closed and opened by fuel injected through the outlet passageway by the piston.

5. An apparatus as in claim 4, in which the check valve comprises a valve seat, a valve element formed with said axial passageway therethrough and a spring urging the valve element toward sealing engagement with the valve seat.

6. An apparatus as in claim 1, in which the regulator means comprises a modulator valve having an inlet connected to the outlet of the fuel supply pump, an outlet connected to the inlet of the fuel supply pump and a modulation control inlet connected to an outlet of the second fuel injection pump.

7. An apparatus as in claim 6, further comprising a flow restrictor connected between the outlet of the fuel supply pump and the inlet of the modulator valve.

8. An apparatus as in claim 7, in which the modulator valve comprises a bored cylinder communicating with the inlet and outlet of the modulator valve, a valve element sealingly slidable in the cylinder bore for controlling communication between the inlet and outlet of the modulator valve and a compression spring engaging a first end of the valve element, the control inlet of the modulator valve communicating with a second and opposite end of the valve element.

9. An apparatus as in claim 1, in which the actuator means comprises a hydraulic jack means connected to the control member.

10. An apparatus as in claim 9, in which the actuator means further comprises a cam means connected between the hydraulic jack means and the control member.

11. An apparatus as in claim 1, further comprising a governor means constructed to position the control member in combination with the actuator means.

12. An apparatus as in claim 11, in which the governor means comprises a centrifugal governor.

13. An apparatus as in claim 12, in which the centrifugal governor is constructed to move the control member when the engine speed exceeds a predetermined value, the regulator means and actuator means being constructed to move the control member when the engine speed is below the predetermined value.

14. An apparatus as in claim 11, in which the governor means and actuator means are mechanically connected in series.

15. An apparatus as in claim 11, in which the actuator means is arranged to limit movement of the control member by the governor means.

* * * * *